US006759940B2

(12) United States Patent
Mazzochette

(10) Patent No.: US 6,759,940 B2
(45) Date of Patent: Jul. 6, 2004

(54) TEMPERATURE COMPENSATING DEVICE WITH INTEGRAL SHEET THERMISTORS

(75) Inventor: Joseph Mazzochette, Cherry Hill, NJ (US)

(73) Assignee: Lamina Ceramics, Inc., Westhampton, NJ (US)

( * ) Notice: Subject to any disclaimer, the term of this patent is extended or adjusted under 35 U.S.C. 154(b) by 0 days.

(21) Appl. No.: 10/043,582

(22) Filed: Jan. 10, 2002

(65) Prior Publication Data

US 2003/0128096 A1 Jul. 10, 2003

(51) Int. Cl.[7] ..... H01C 7/13

(52) U.S. Cl. ..... 338/22 R; 338/22 SD; 338/313; 338/314; 338/195; 338/239; 338/319; 338/320

(58) Field of Search ..... 338/22 R, 22 SD, 338/23, 25, 28, 239, 252, 253, 195, 311, 312, 313, 314, 320; 29/612

(56) References Cited

U.S. PATENT DOCUMENTS 3,916,264 A * 10/1975 Berg ..... 361/106
4,504,817 A * 3/1985 Shikama et al. ..... 338/23
5,332,981 A * 7/1994 Mazzochette et al. .... 333/81 R
5,473,304 A * 12/1995 Friese et al. ..... 338/23
5,493,266 A * 2/1996 Sasaki et al. ..... 338/22 R
5,500,996 A * 3/1996 Fritsch et al. ..... 29/612
6,020,808 A * 2/2000 Hogge ..... 338/22 R
6,284,080 B1 * 9/2001 Haq et al. ..... 156/89.16
6,311,390 B1 * 11/2001 Abe et al. ..... 29/612
6,362,723 B1 * 3/2002 Kawase ..... 338/22 R
6,400,251 B1 * 6/2002 Abe et al. ..... 338/22 R
6,498,068 B1 * 12/2002 Ueda et al. ..... 438/385
6,525,395 B1 * 2/2003 Kawase et al. ..... 257/528
6,570,477 B2 * 5/2003 Park et al. ..... 336/200
6,588,094 B2 * 7/2003 Furukawa et al. ..... 29/610.1

FOREIGN PATENT DOCUMENTS

JP 4-320301 * 11/1992 ..... 338/22 SD

OTHER PUBLICATIONS

Thick Film Technology, Agnew, J., Hayden Book Col, CH. 6, pp. 65–73 (Aug. 1973).*
JP 1–66906 Yoneda, english abstract, figs1–3, (3/989).*
US2002/0050914 Chiang et al. (May 2002, filed Apr. 1998).*

* cited by examiner

*Primary Examiner*—Karl D. Easthom
(74) *Attorney, Agent, or Firm*—Lowenstein Sandler PC

(57) ABSTRACT

In accordance with the invention, a temperature compensating device comprises one or more integrated sheet thermistors. Because the sheet thermistors are relatively thick and integral with the substrate, they are less susceptible to changes in air temperature and to temperature gradients. Moreover, the sheet thermistors can be made smaller in area, permitting more compact, less expensive devices that exhibit improved high frequency performance. The devices can advantageously be fabricated using the low temperature co-fired ceramic (LTCC) process.

9 Claims, 4 Drawing Sheets

TEMPERATURE COMPENSATING DEVICE WITH INTEGRAL SHEET THERMISTORS

FIELD OF THE INVENTION

This invention relates to temperature compensating devices for compensating the effect of temperature changes in an electrical or electronic circuit. In particular, it relates to a temperature compensating device using integrated sheet thermistors for enhanced performance.

BACKGROUND OF THE INVENTION

Temperature compensating devices are important components in a wide variety of electrical and electronic circuits such as high frequency communication circuits. Communication circuits are typically constructed using components, such as semiconductor devices, whose properties change with temperature. For example, solid state amplifiers are made using semiconductor components, and the current carrying ability of these components decreases with increasing temperature, reducing the gain of the amplifier. In the absence of compensation, such temperature-induced changes can deteriorate the performance of the circuit.

One method for compensating temperature-induced changes in a communication circuit is to cascade the circuit with a temperature compensating device whose pertinent characteristics vary oppositely with temperature. For example, an amplifier can be cascaded with a compensating device that increases in gain with increasing temperature. The cascaded combination minimizes gain variation with temperature.

U.S. Pat. No. 5,332,981 issued to the present applicant and John Steponick on Jul. 26, 1994, and is incorporated herein by reference. The '981 patent, which is entitled "Temperature Variable Attenuator," describes a passive temperature compensating device using at least two different thermistors which are deposited as films on a substrate. The temperature coefficients of the thermistors are different and are selected so that the attenuation changes at a controlled rate with temperature while the impedance remains substantially constant.

Difficulties with the '981 device arise because the device relies on thermistors formed as thin, relatively large area films. The large area thin films are unduly susceptible to changes in air temperature. Moreover, there can be substantial temperature gradients across the thickness between the film/air interface and the film/substrate interface. As one consequence, forced air cooling, typically used for other systems components, can vary the thermistor temperature and produce unwanted gain ripple. Another difficulty is that the relatively large area of the film requires a relatively large substrate. This increases cost, consumes board space, and degrades high frequency performance. A third difficulty arising from the thin thermistor film is the difficulty in constructing the small size, low ohmic value thermistors required for low impedance circuits (50 Ω). The thin layers are highly resistive. Accordingly there is a need for improved temperature compensating circuits.

SUMMARY OF THE INVENTION

In accordance with the invention, a temperature compensating device comprises one or more integrated sheet thermistors. Because the sheet thermistors are relatively thick and integral with the substrate, they are less susceptible to changes in air temperature and to temperature gradients. Moreover, the sheet thermistors can be made smaller in area, permitting more compact, less expensive devices that exhibit improved high frequency performance. The devices can advantageously be fabricated using the low temperature co-fired ceramic (LTCC) process.

BRIEF DESCRIPTION OF THE DRAWINGS

The advantages, nature and various additional features of the invention will appear more fully upon consideration of the illustrative embodiments now to be described in detail in connection with the accompanying drawings. In the drawings.

It is to be understood that the drawings are for illustrating the concepts of the invention and are not to scale.

DETAILED DESCRIPTION

In essence, a temperature compensating device in accordance with the invention comprises an integrated structure composed of a plurality of sheet thermistors separated by ceramic sheets. A sheet is typically a layer having a thickness of about 0.001" or more. Each sheet thermistor comprises a sheet composed of thermistor material having a pair of major surfaces that are preferably parallel. Electrodes laterally spaced apart on the major surfaces define one or more thermistors composed of the thermistor material in the region between the laterally spaced apart electrodes. The thermistors on different levels can be interconnected by metallized grooves or vias into any one of a variety of temperature compensating circuits.

Figure 1A:
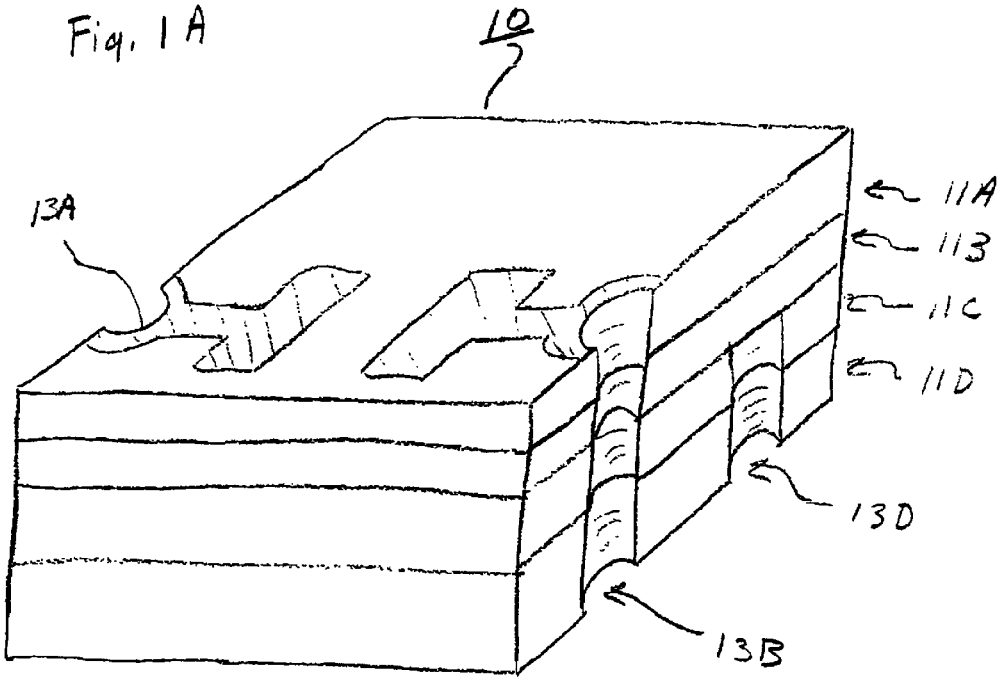
FIGS. 1A and 1B are side and bottom perspective views of an exemplary temperature compensating device employing integral sheet thermistors.

Referring to the drawings, FIG. 1A provides a perspective view of an exemplary temperature compensating device 10 comprising four integrated sheets 11A, 11B, 11C and 11D. Sheet 11A comprises a first sheet thermistor. Sheets 11B and 11C are ceramic sheets, and sheet 11D comprises a second sheet thermistor.

Conductively coated notches 13A, 13B, 13C and 13D conveniently provide input, output and ground contacts.

Figure 2:
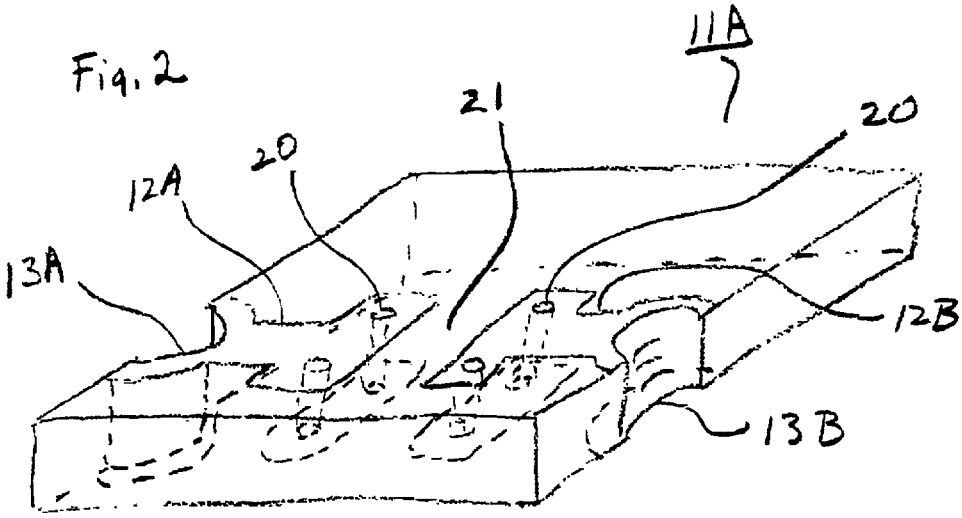
FIG. 2 is a transparent perspective view of a first sheet thermistor used in the device of FIG. 1.

The structure and operation of the device can be more clearly understood by consideration of the various constituent sheets. FIG. 2 illustrates the first sheet thermistor 11A. The sheet 11A is composed of thermistor material such as platinum-based negative temperature coefficient (NTC) thermistor material in a glass frit. The sheet is provided with conductively coated notches 13A, 13B and conductively filled holes 20. A top conductive pattern and a bottom conductive pattern, form a pair of electrodes 12A, 12B separated by a region 21 of NTC material. The NTC material 21 between the two electrodes constitutes an NTC thermistor serially connected between notches 13A, 13B.

Figure 3A:
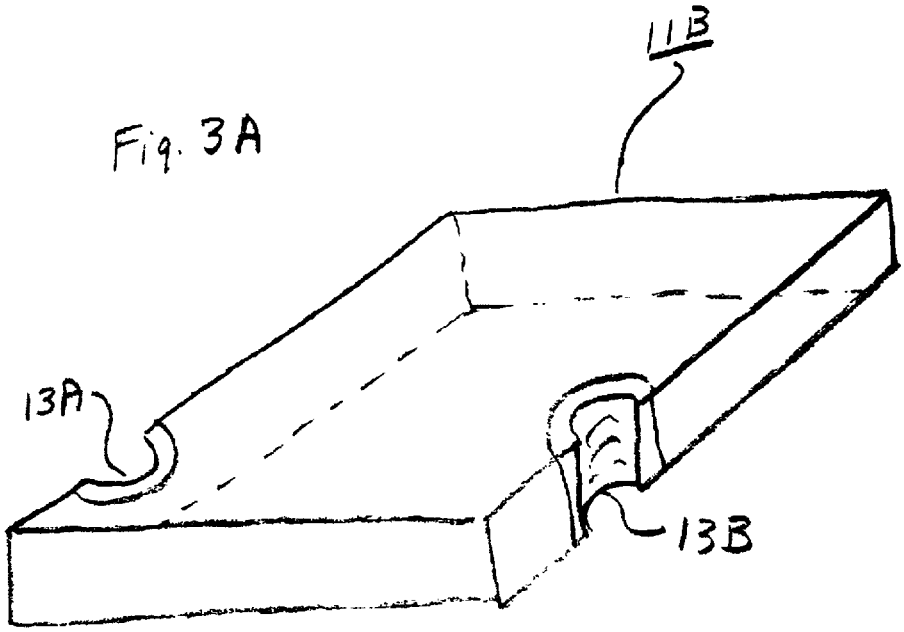
FIGS. 3A and 3B are views of ceramic sheets used in the device of FIG. 1.
Figure 3B:
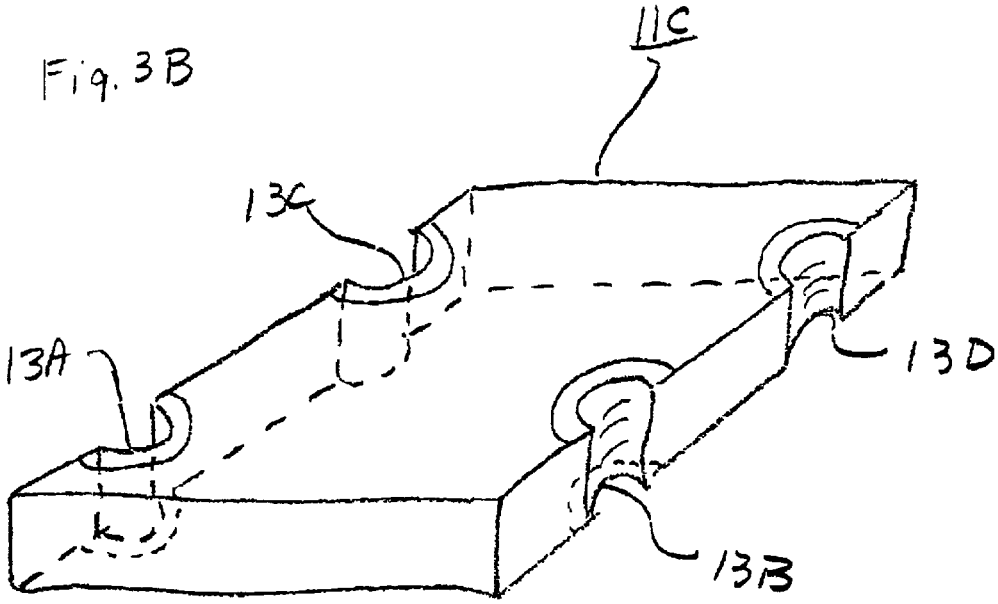

FIGS. 3A and 3B show the ceramic sheets 11B and 11C, respectively. Sheet 11B can be a notched sheet of ceramic material. The notches 13A and 13B are coated with conductive material to provide good electrical contact. The ceramic should be an insulating ceramic with good thermal conductivity. FIG. 3B shows a similar sheet that can be used for ceramic sheet 11C.

Figure 4:
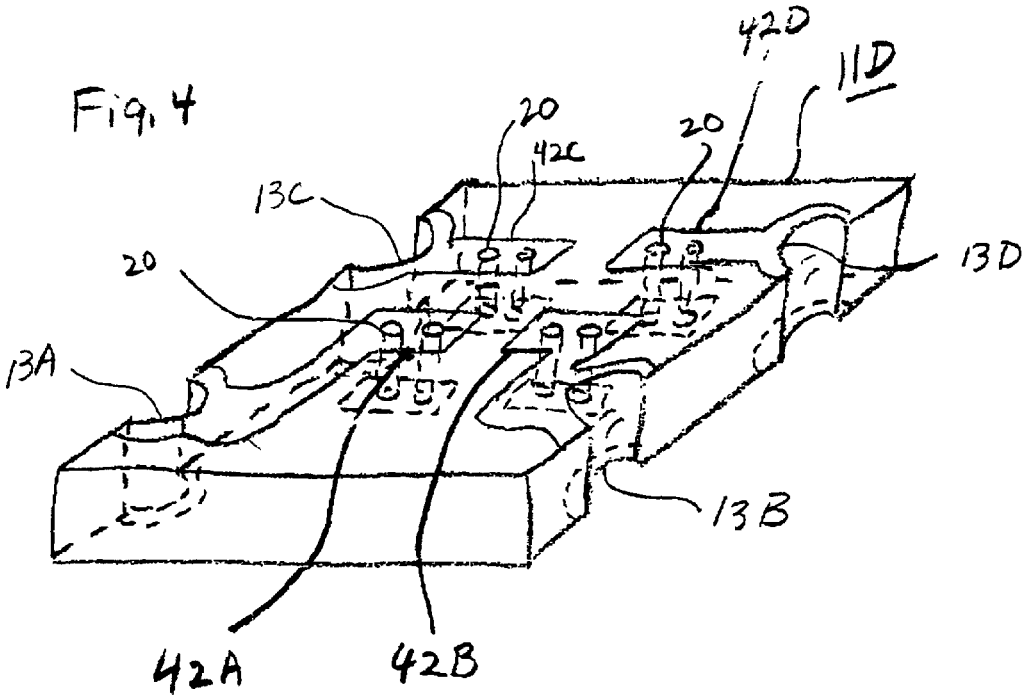
FIG. 4 is a transparent perspective view of a second sheet thermistor used in the device of FIG. 1.

FIG. 4 shows the second sheet thermistor 11D. The sheet can be composed of oxide-based positive temperature coefficient (PTC) thermistor material in a glass frit. The sheet has conductively coated notches 13A, 13B, 13C and 13D, conductively filled holes 20 and metallization patterns forming electrodes 42A, 42B, 42C and 42D. After firing, the regions of PTC material between the electrodes 42A and ground electrode 42C and between 42B and 42D form PTC thermistors to ground.

Figure 5:
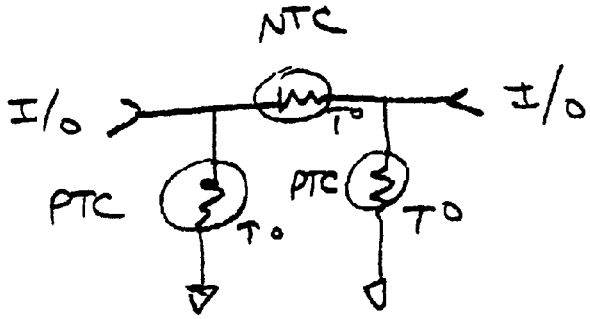
FIG. 5 is a schematic circuit diagram of the device of FIG. 1.

It can be seen that the metallization patterns of FIGS. 2, 3, 4 interconnect the sheet thermistors 11A, 11D into the $\pi$ configuration temperature compensating circuit schematically shown in FIG. 5. Sheet 11A corresponds to the NTC thermistor and sheet 11D provides the two PTC thermistors connected to ground. The operation of this and other suitable temperature compensating circuits is described in the aforementioned U.S. Pat. No. 5,332,981 patent and *Reference Data for Engineers: Radio, Electronics, and Communications*, Seventh Edition, Howard W. Sams & Co., Indianapolis, Ind., 1985, page 11–4.

Figure 1B:
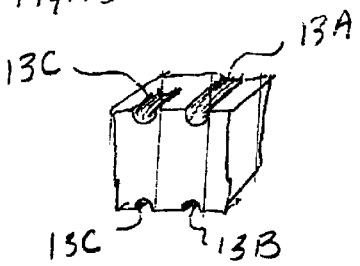

The device of FIG. 1 is relatively easy to fabricate using the LTCC process. In essence, the sheet thermistors shown in FIGS. 2 and 4 are fabricated by providing green sheets of thermistor material in a sinterable base such as a glass frit. Each green sheet is prepunched for holes 20 and notches 13A, and conductive inks are applied to coat the notches, fill the holes and print the pattern for the electrodes. The green ceramic sheets need merely be notched and have the notches coated. The green sheets are then stacked and co-fired into an integral body.

The thermistor material can be negative coefficient of temperature ("NTC") material or positive coefficient of temperature ("PTC") material. NTC thermistors are typically based on oxides such as MgO or barium titanate; PTC thermistors are typically platinum-based. The ohmic value of each thermistor at a given temperature is determined by the width of the electrodes (w), the thickness of the thermistor sheet (t), the gap (g) between the electrodes and the resistivity $\rho$ of the material. The resistance R is given by $R=\rho g/tw$. It will be appreciated that the metallization pattern can be configured to form any one of a variety of temperature compensating circuits.

As compared with prior temperature compensating devices using thin film thermistors, the sheet thermistor device of FIGS. 1–4 reduces air temperature modulation and thermal gradient problems since the thermistors are thicker, smaller in area and integral with ceramic layers. Because the thermistors are thicker, it is easier to define low ohmic value devices.

An additional advantage is that the device provides an easy way to trim the resistance value of individual thermistors. The ohmic value of each thermistor can be increased by reducing the amount of thermistor material between electrodes. The material can be removed by etching, laser trimming or abrasive trimming.

The invention can now be understood more clearly by consideration of the following specific embodiment.

EXAMPLE

An exemplary temperature compensating device can be constructed using the DuPont LTCC system 951, described in the DuPont material data sheet entitled "951 Low-Temperature Cofire Dielectric Tape". The tape is a mixture of organic binder and glass. When fired the tape forms the ceramic substrate for the circuit. Individual circuits are formed on a large wafer and then singulated after processing. A thermistor tape may be formulated that is compatible with the 951 tape, but will include a metal—metal (platinum) conductor material with a positive TCR. Compatibility of TCE and sintering characteristics with the 951 tape is necessary to achieve the necessary part performance. A thermistor tape may be formulated that is compatible with the 951 tape, but will include a metal oxide such as magnesium oxide conductor material with a negative TCR. Compatibility of TCE and sintering characteristics with the 951 tape is again necessary to achieve the necessary part performance. Prior to firing holes, or vias, are punched in both the 951 and thermistor tapes. The holes correspond to the location of the thermistor electrodes. The active thermistor is formed between the rows of filled vias. After punching the vias are filled with DuPont 6141 silver conductor to form electrically conductive connections. Printing is accomplished using a squeegee printer and a metal stencil. After printing, the solvents in the material are dried at 70° C. for 30 minutes. Electrically conductive interconnections are then made by screen printing a metal ink such as DuPont 6142 silver. All conductor prints must be dried. After the via holes are filled and conductive traces are printed and dried the separate tape layers are aligned, stacked, and tacked together using a high temperature (200° C.), 3 mm diameter tool. The stacked tapes are then laminated at 3000–4000 PSI at 70° C. After lamination the assembly is heated to 400° C. to burn off the organic materials in the tape layers. After the burn-off stage the assembly is heated to 850° C. to sinter the glass. As the assembly exits the furnace and cools the circuit forms a solid ceramic mass. After firing individual circuits are separated from the wafer by dicing.

It is understood that the above-described embodiments are illustrative of only a few of the many possible specific embodiments, which can represent applications of the invention. Numerous and varied other arrangements can be made by those skilled in the art without departing from the spirit and scope of the invention.

What is claimed is:

1. An attenuator device having at least two ports, the attenuator to compensate the effect of temperature changes in an electronic circuit, the device comprising:

a low temperature co-fired ceramic (LTCC) integrated package including a substrate having a pair of major surfaces;

a plurality of thermistors embedded within the substrate, at least one of the thermistors comprising a sheet of thermistor material having a pair of major surfaces and a pair of electrodes formed on and laterally spaced apart by the major surfaces, the thermistor sheet layered with insulating layers and the electrodes on the major surfaces interconnecting the thermistors, the thermistors forming the components of an attenuator in a temperature compensating circuit; and at least three terminals forming the at least two ports, wherein one of the terminals comprises an input electrode connected to one of the thermistors, one of the terminals comprises an output electrode connected to at least one different thermistor, and one of the terminals comprises a common terminal.

2. A device according to claim 1 wherein each electrode comprises a first portion on one major surface, a second portion on the other major surface and one or more conductive vias connecting the first and second portions.

3. A device according to claim 1 wherein the sheet of thermistor material has a thickness of about 0.001 inch or more.

4. The device of claim 1 wherein the insulating layer comprises a ceramic substrate formed from organic binder and glass.

5. The device of claim 1 wherein the attenuator comprises a circuit topology selected from the group consisting of pi attenuator, T attenuator, and bridged T attenuator.

6. An electronic circuit comprising an amplifier and a device according to claim 1 having thermistors with temperature coefficients to compensate for temperature induced gain changes at the amplifier.

7. An electronic circuit comprising a passive electronic circuit and a device according to claim 1, the temperature coefficients of the thermistors to compensate for changes in the passive circuit's loss with temperature.

8. The device of claim 1 wherein at least one of the thermistors has a different temperature coefficient than another of the thermistors of the attenuator.

9. The device of claim 1 wherein one thermistor has a positive temperature coefficient and a different thermistor has a negative temperature coefficient.

* * * * *